US006185797B1

(12) United States Patent
Lan et al.

(10) Patent No.: US 6,185,797 B1
(45) Date of Patent: Feb. 13, 2001

(54) LIFT-CONTROL BUCKLE

(75) Inventors: Chin-Kuo Lan, Ping-Chen; Tsung-Min Kung, Kaohsiung; Wen-Chin Lin, Taoyuan; Hung-Te Hou, Taichung, all of (TW)

(73) Assignee: Taiwan Industrial Fastener Corporation, Taipei (TW)

( * ) Notice: Under 35 U.S.C. 154(b), the term of this patent shall be extended for 0 days.

(21) Appl. No.: 09/376,306

(22) Filed: Aug. 18, 1999

(51) Int. Cl.[7] ..... A44B 11/25
(52) U.S. Cl. ..... 24/647; 24/650
(58) Field of Search ..... 24/647, 650, 643, 24/644, 645, 170, 180, 191

(56) References Cited

U.S. PATENT DOCUMENTS 3,328,856 * 7/1967 Jonas .
4,631,784 * 12/1986 Fildan .
4,924,562 * 5/1990 Pogharian .
4,937,923 * 7/1990 McEntire .
4,958,416 * 9/1990 Frishling .
5,431,365 * 7/1995 Hopkins .
5,435,047 * 7/1995 Colpo .
5,572,771 * 11/1996 Kelleghan .
5,832,573 * 11/1998 Howell .
5,920,963 * 7/1999 Chou .

* cited by examiner

*Primary Examiner*—James R. Brittain
(74) *Attorney, Agent, or Firm*—Robert E. Bushnell, Esq.

(57) ABSTRACT

A lift-control buckle, which includes a female buckle member and a male buckle member respectively fastened to two distal ends of a belt, and a locking plate pivoted to two upright blocks inside the female buckle for locking the male buckle member after insertion of the male buckle member into a receiving space defined within the male buckle member between the upright blocks, wherein the locking plate has two springy side arms respectively supported on a respective step inside the female buckle member and stopped against the upright blocks for automatically returning the locking plate to the locking position after each unlocking operation.

4 Claims, 6 Drawing Sheets

LIFT-CONTROL BUCKLE

BACKGROUND OF THE INVENTION

The present invention relates to a belt buckle, and more particularly to a locking plate for a lift-control type belt buckle which automatically returns to its former position after each unlocking operation.

A regular belt buckle is generally comprised of a female buckle member and a male buckle member respectively fastened to the two distal ends of a belt, and a locking plate pivoted to the female buckle member for locking the male buckle member after insertion of the male buckle member into the female buckle member. In order to automatically return the locking plate to the locking position after each unlocking operation, a return spring is used. However, the use of such a return spring complicates the assembly process of the belt buckle and, simultaneously increases the manufacturing cost of the belt buckle.

SUMMARY OF THE INVENTION

The present invention has been accomplished under the circumstances in view. According to the present invention, the lift-control type belt buckle comprises a female buckle member and a male buckle member respectively fastened to two distal ends of a belt, and a locking plate pivoted to two upright blocks inside the female buckle for locking the male buckle member after insertion of the male buckle member into a receiving space defined within the male buckle member between the upright blocks, wherein the locking plate has two springy side arms respectively supported on a respective step inside the female buckle member and stopped against the upright blocks for automatically returning the locking plate to the locking position after each unlocking operation. Because the springy side arms are formed integral with the locking plate, the formation of the springy side arms neither complicates the assembly process of the belt buckle nor increases its manufacturing cost.

DETAILED DESCRIPTION OF THE PREFERRED EMBODIMENT

Figure 1:
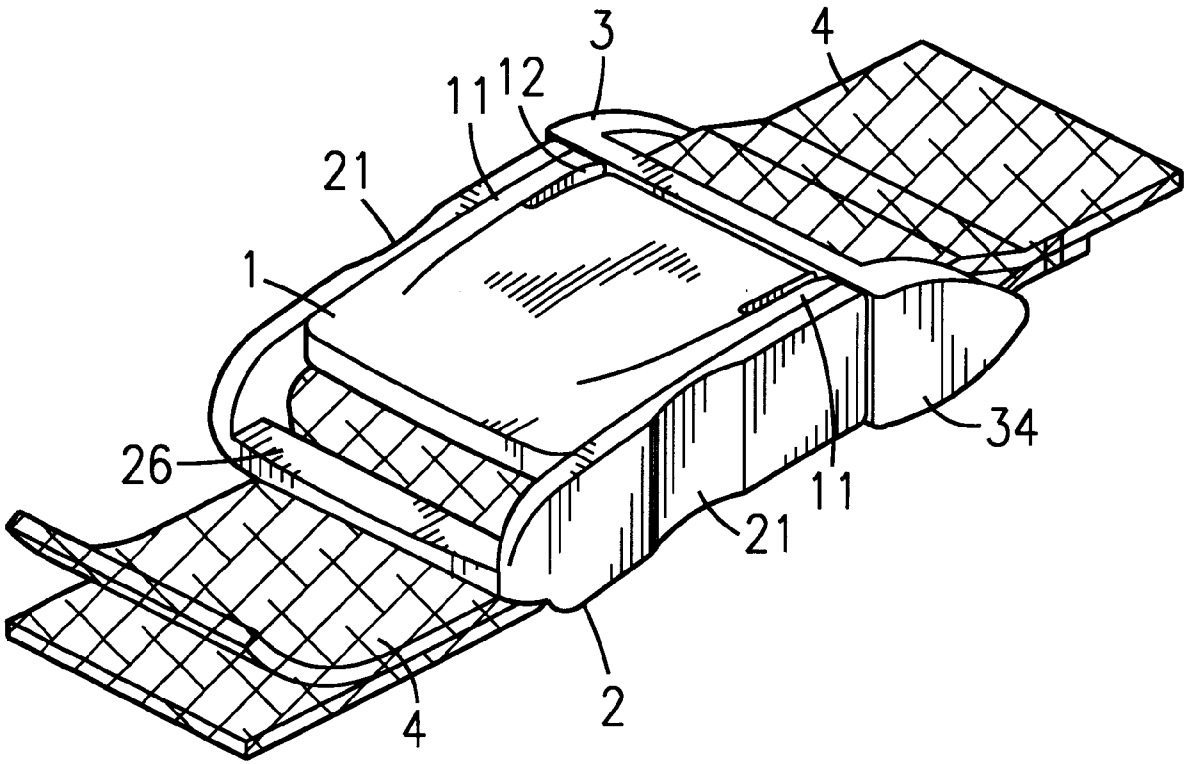
FIG. 1 is an oblique elevation of the present invention showing the back side of the belt buckle when installed.
Figure 2:
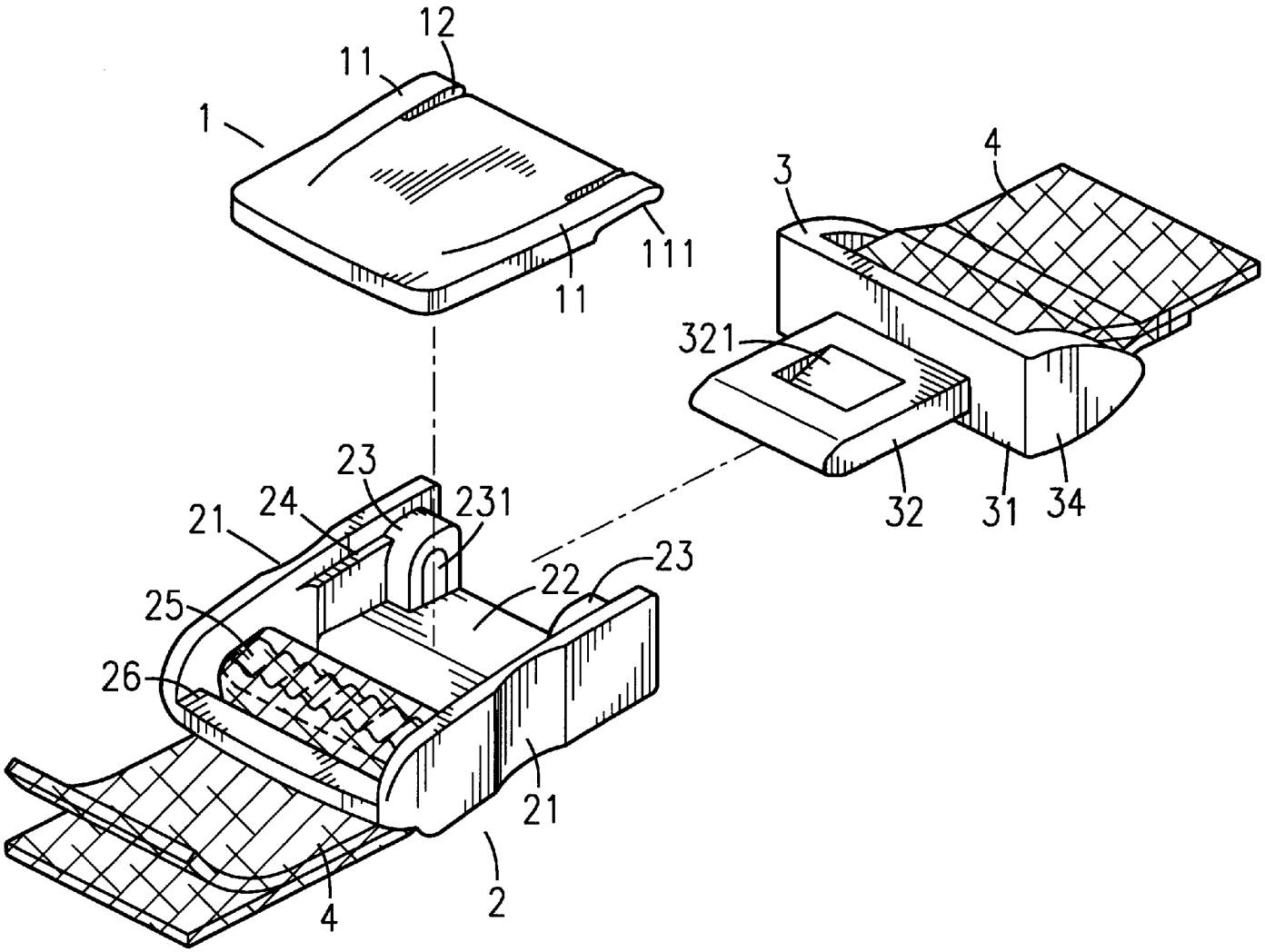
FIG. 2 is an exploded view of the belt buckle according to the present invention.

Referring to FIGS. 1 and 2, a lift-control type belt buckle is shown comprised of a locking plate 1, a female buckle member 2, and a male buckle member 3.

Figure 4:
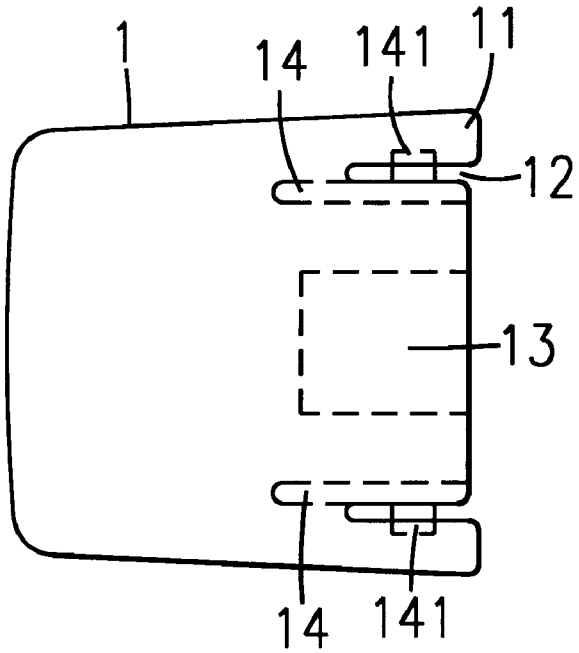
FIG. 4 is a top plain view of the locking plate for the belt buckle according to the present invention.
Figure 3:
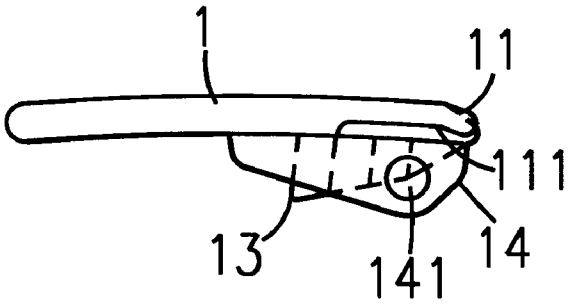
FIG. 3 is a side plain view of the locking plate for the belt buckle according to the present invention.

Referring to FIGS. 3 and 4 and FIGS. 1 and 2 again, the locking plate 1 comprises two springy side arms 11 arranged in parallel, the side arms 11 each having a smoothly arched front guide edge 111, a springy hook 13, two elongated splits 12 spaced between the side arms 11 and two opposite lateral sides of the hook 13, two flanges 14 perpendicularly raised from the bottom side wall thereof and formed integral with the hook 13 at two opposite lateral sides, and two pivots 141 respectively formed integral with the flanges 14 at an outer side. The female buckle member 2 is a U-shaped frame comprising two upright side walls 21, a receiving space 22 defined between the upright side walls 21, two upright blocks 23 respectively formed integral with the upright side walls 21 within the receiving space 12 at a front side, two pivot holes 231 respectively provided at the upright blocks 23 and aimed at each other which receive the pivots 141 respectively for enabling the locking plate 1 to be turned about an axis passing through the pivot holes 231 relative to the female buckle member 2, two horizontal steps 24 respectively formed integral with the upright side walls 21 within the receiving space 12 and extended backwards from the upright blocks 23 for supporting the side arms 11 of the locking plate 1, a rear bumper 26 connected between the upright side walls 21 at a rear side remote from the upright blocks 23, an insertion slot 27 transversely disposed at the bottom side wall there between the upright side walls 11 in front of the rear bumper 26 (please see also FIG. 5), and a transverse locating block 25 connected between the upright side walls 21 and suspended above the insertion slot 27. The top side wall of the transverse locating block 25 is preferably serrated or corrugated for positive positioning of a belt 4. One end of the belt 4 is inserted through the insertion slot 27, then turned back and passed over the transverse locating block 25, and then extended out of the insertion slot 27. The other end of the belt 4 is fixedly connected to the male buckle member 3. The male buckle member 3 is fixedly connected to one end of the belt 4, comprising a vertical front wall 31, two side walls 34 convenient for the positioning of the fingers, a tongue 32 perpendicularly raised from the vertical front wall 31 on the middle, and a sloping retaining recess 321 formed on the tongue 32 at a top side.

Figure 5:
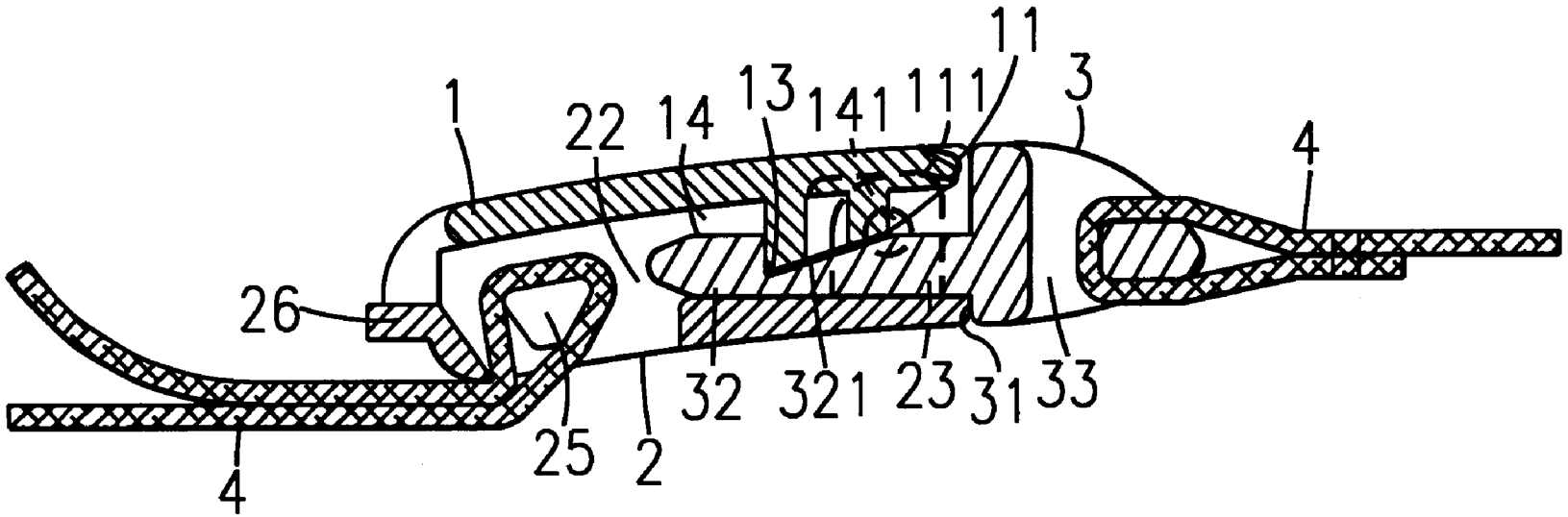
FIG. 5 is a sectional side view of the present invention, showing the male buckle member locked.

Referring to FIG. 5 and FIG. 1 again, during the assembly process of the buckle, the pivots 13 of the locking plate 1 are respectively forced into the pivot holes 231 at the female buckle member 2, enabling the side arms 11 to be respectively supported on the steps 24 in the female buckle member 2 and the smoothly arched front guide edge 111 of each of the side arms 11 to be respectively stopped against the upright blocks 23 at the female buckle member 2, and the tongue 32 of the male buckle member 3 is then inserted into the receiving space 22 in the female buckle member 2 between the upright blocks 23, enabling the vertical front wall 31 of the male buckle member 3 to be stopped against the upright side walls 21 of the female buckle member 3.

Figure 6:
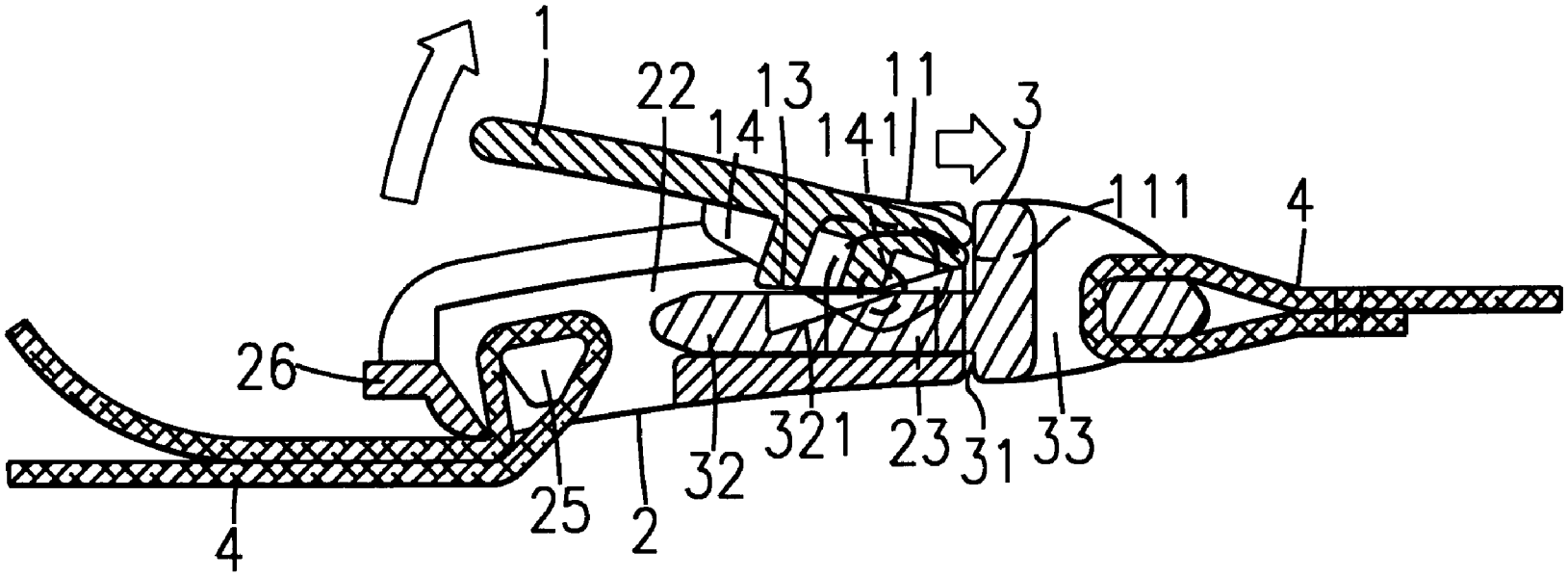
FIG. 6 is similar to FIG. 5 but showing the locking plate turned upwards and disengaged from the male buckle member.
Figure 7:
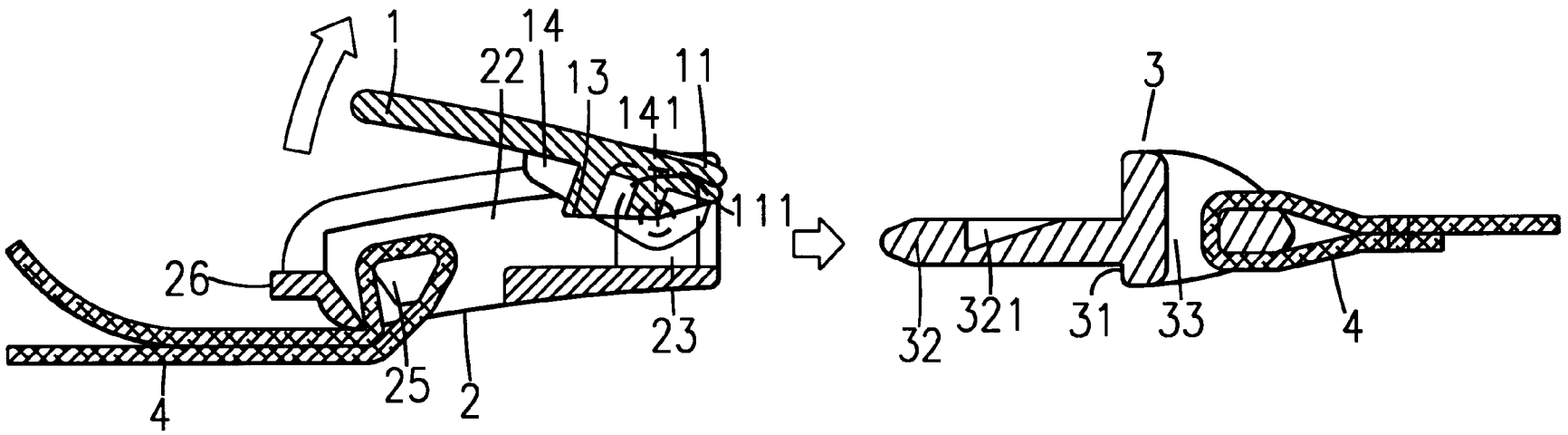
FIG. 7 is a sectional view of the present invention, showing the male buckle member disconnected from the female buckle member.

Referring to FIGS. 6 and 7, when inserting the tongue 32 of the male buckle member 3 into the receiving space 22 in the female buckle member 2 between the upright blocks 23, the springy hook 13 is forced to pass over the front side of the tongue 32 and then to engage into the sloping retaining recess 321, and therefore the male buckle member 3 is firmly secured to the female buckle member 2. When turning the locking plate 1 clockwise relative to the female buckle member 3, the springy side arms 11 are curved, and the hook 13 is disengaged from the sloping retaining recess 321, enabling the male buckle member 3 to be disconnected from the female buckle member 2. After disconnection of the male buckle member 3 from the female buckle member 2, the locking plate 1 is released from the hand, the springy side arms 11 immediately return to their former shape, thereby causing the locking plate 1 to be returned to its former position.

While only one embodiment of the present invention has been shown and described, it will be understood that various modifications and changes could be made thereunto without departing from the spirit and scope of the invention disclosed.

What the invention claimed is:

1. A lift control buckle of the type comprising:

a female buckle member, said female buckle member comprising two upright side walls, a receiving space defined between said upright side walls, two upright blocks respectively formed integral with said upright side walls within said receiving space at a front side, two pivot holes respectively provided at said upright blocks and aimed at each other, and two horizontal steps respectively formed integral with said upright side walls within said receiving space and extended backwards from said upright blocks;

a male buckle member, said male buckle member comprising a vertical front wall, a tongue perpendicularly raised from said vertical front wall on the middle for insertion into the receiving space in said female buckle member between said upright blocks, and a sloping retaining recess formed on said tongue at a top side; and a locking plate pivoted to said upright blocks within said pivot holes of said female buckle member and supported on said steps inside said female buckle member, said locking plate having a hook for hooking in the sloping retaining recess to secure said male buckle member to said female buckle member;

wherein said locking plate comprises two springy side arms spaced from said hook at two opposite sides and respectively supported on said steps inside said female buckle member and stopped against said upright blocks of said female buckle member.

2. The lift-control buckle of claim 1 wherein said springy side arms each have a smoothly arched front guide edge respectively stopped against said upright blocks of said female buckle member.

3. A lift-control buckle of the type comprising:

a female buckle member, said female buckle member comprising two upright side walls, a receiving space defined between said upright side walls, two upright blocks respectively formed integral with said upright side walls within said receiving space at a front side, and two horizontal steps respectively formed integral with said upright side walls within said receiving space and extended backwards from said upright blocks;

a male buckle member, said male buckle member comprising a vertical front wall, a tongue perpendicularly raised from said vertical front wall on the middle for insertion into the receiving space in said female buckle member between said upright blocks, and a sloping retaining recess formed on said tongue at a top side; and a locking plate pivoted to said upright blocks of said female buckle member and supported on said steps inside said female buckle member, said locking plate having a hook for hooking in the sloping retaining recess to secure said male buckle member to said female buckle member;

wherein said locking plate comprises two springy side arms spaced from said hook at two opposite sides and respectively supported on said steps inside said female buckle member and stopped against said upright blocks of said female buckle member.

4. The lift-control buckle of claim 3 wherein said springy side aims each have a smoothly arched front guide edge respectively stopped against said upright blocks of said female buckle member.

* * * * *